United States Patent [19]

Brooks

[11] 4,235,039

[45] Nov. 25, 1980

[54] PLAY DOLL HOUSE AND FURNITURE PUZZLE

[76] Inventor: Lula M. Brooks, 10316-111 Place North, Largo, Fla. 33543

[21] Appl. No.: 11,178

[22] Filed: Feb. 12, 1979

[51] Int. Cl.[3] ..... A63H 33/00

[52] U.S. Cl. ..... 46/12; 46/15; 273/157 R

[58] Field of Search ..... 46/11, 12, 13, 14, 15, 46/16, 17, 18, 19, 21; 273/156, 157 R, 160

[56] References Cited

U.S. PATENT DOCUMENTS

| | | | |
|---|---|---|---|
| 1,016,208 | 1/1912 | Cass | 46/18 |
| 1,063,472 | 6/1913 | Schultz | 273/157 R X |
| 1,443,217 | 1/1923 | Dodd | 273/157 RX |
| 1,525,103 | 2/1925 | Orr | 273/157 R X |
| 3,410.021 | 11/1968 | Patterson | 46/16 X |

*Primary Examiner*—F. Barry Shay
*Attorney, Agent, or Firm*—John F. McClellan, Sr.

[57] ABSTRACT

A play doll house and furniture puzzle combination includes a plurality of pieces of furniture all of which have at least one common dimension and a play doll house having an interior space with a length equalling the common dimension of the furniture but wide and tall enough to contain all the furniture when fitted into the space in predetermined puzzling nesting relation, with the common dimension of each piece along the length of the play doll house; in preferred embodiment the play doll house has interior congruency type markings on the front wall providing a first, or easy mode of assembly; a symmetrical gable roof defining the upper part of the space, which is accessible through double, outside-hinged doors at the rear of the house, prevents the space from being rectangular and limits other possibilities of assembly to a second or harder mode of assembly which is 180° in rotation about the vertical axis from the first mode of assembly and out of congruency with the markings; the front of the play doll house repeats in Swiss Chalet style the gable-roof motif.

1 Claim, 4 Drawing Figures

PLAY DOLL HOUSE AND FURNITURE PUZZLE

This invention relates generally to toys and specifically to multiple piece toys in which the individual pieces have predetermined relations in an assembly but have separate utility apart from the assembly.

Important objects of the invention are to provide a new play doll house and furniture type toy which is both amusing and educational, which encourages children both to use their imaginations and to follow discipline of a system; which provides a puzzle of varying degrees of difficulty tending to induce prompt and complete pickup and orderly storage of parts after play ends; and which is esthetically pleasing in all aspects.

Further important objects are to provide a new toy as described which requires a minimum of space in storage but which permits the user to expand the furniture in arrangement into the room while still associating it with the play doll house; to provide a puzzle which can interest children of most ages and adults, and which is economical, durable and safe.

In brief summary given for cursive description only, the invention includes a play doll house and furniture combination in which a common dimension of furniture pieces fits the length of the doll house and promotes a puzzling orderly relation for storage in the doll house of the pieces which otherwise have varied dimensions.

The above and other objects and advantages of this invention will become more readily apparent on examination of the following description, including the drawings, in which.

Figure 1:
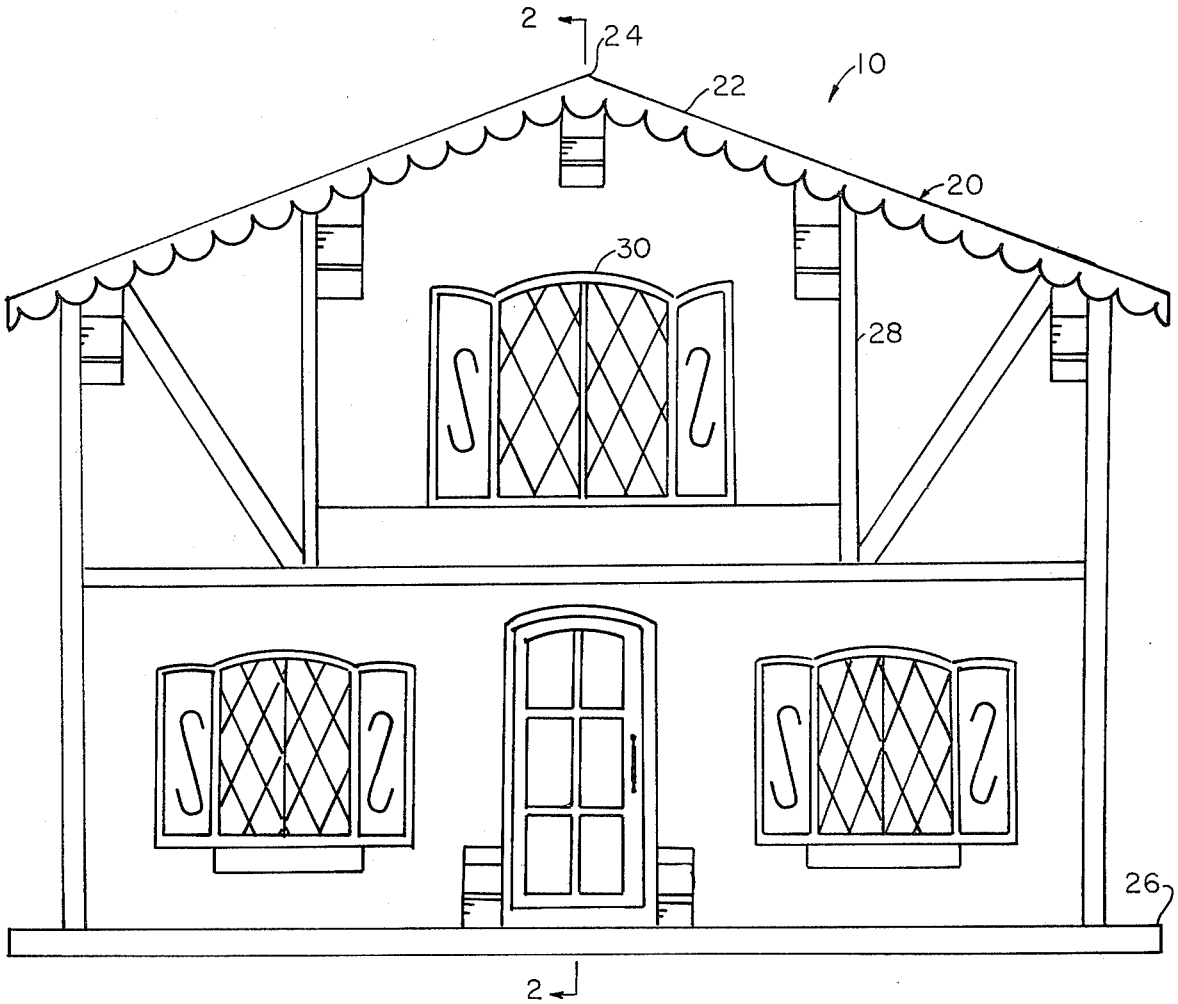
FIG. 1 is a front elevational view of the play doll house.

FIG. 1 shows invention 10 as including a play doll house 20, indicated in front elevational view, with gable roof 22, rising to a peak 24 symmetrically in the center. The base 26 extends at the sides and strips 28 and applied cutout shapes 30 of windows and door conform esthetically to the sharp gable in Swiss Chalet style, preferably, for educating the user to recognize such in later life when seen in full scale dwellings.

Figure 2:
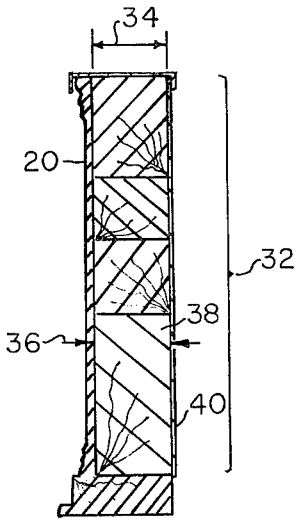
FIG. 2 is a view on a reduced scale taken at 2—2, FIG. 1, of the play doll house with pieces of furniture therein.

FIG. 2 shows that the play doll house 20 is longitudinally compressed in proportion to width and height, with a wall, floor and roof conforming space 32 extending throughout the interior and having a length 34 substantially equal to a common dimension 36 determined by opposite surfaces of pieces of furniture 38 provided with the house and otherwise having scale for use with the house in play. With play doll house doors 40 closed, the furniture can be held substantially rattle-free.

Figure 3:
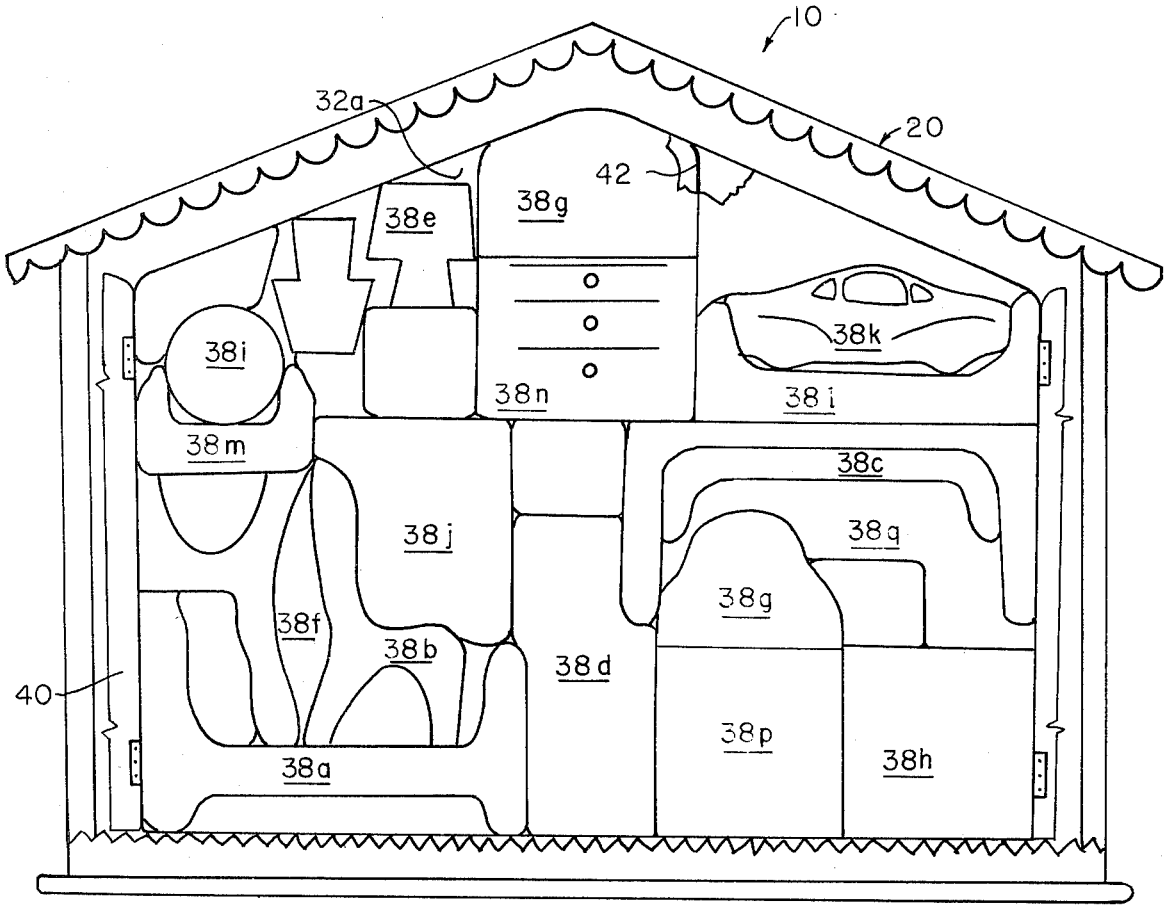
FIG. 3 is a rear elevational partially fragmentary view on a reduced scale, of the play doll house open with furniture arranged in nesting-puzzle style for storage therein.

FIG. 3 shows the rear elevational view of the doll house 20 with doors 40 open (fragmentarily shown for exposition) exposing the complete interior to access, including the space 32*a* at the top conforming to the gable roof, preferably. Some but by no means all pieces of furniture are numbered in the Figure for identification; except for the space noted the furniture fills the entire volume preferably.

Many or most of the individual pieces of furniture are preferably curvilinear in shape, and have varied dimensions and for storage must be arranged to solve the puzzle of conforming nesting as shown, opposed surfaces defining the common dimension of each being in respective planar relations, to fit into the space, which they entirely fill, a first spaced surface being against the end wall and a second spaced surface against the door. The pieces preferably make an assymmetrical pattern as shown within the outline which itself has the single plane of symmetry through the gable and a furniture piece outline or congruent indicia 42 as indicated at the upper right central portion which is partially broken away for exposition, may guide the user in correct arrangement of the furniture for storage. This is the first mode of storage and presents a first or easy or low degree of difficulty. A second or harder mode of storage is also provided in that the gable breaks the rectangularity of the outline of the space, limiting the storage possibilities to two, the second 180° out of register about the single plane of symmetry or vertical centerline of the play doll house, with the first, and out of congruency with most of the indicia, which advantageously mislead as to the second mode, making it even harder.

From the above it will be appreciated that the furniture, when unpacked from planar relation in storage in the puzzle-type nesting array can be arranged into sets or rooms of complimentarily proportion and extended in pattern away from the doll house which may serve as one wall or as a stage. Typically the pieces of furniture, all having one common dimension but providing a variety, include beds 38*a*, chairs 38*b*, tables 38*c*, refrigerator 38*d*, lamps 38*e*, room dividers 38*f*, fireplaces 38*g*, chests of drawers 38*h*, hassocks 38*i*, stoves 38*j*, an automobile 38*k*, sofa 38*l* on which the automobile fits, sofa chair 38*m* which may contain the hassock, hutches 38*n*, dressers 38; and sleds 38*q*. Preferably the assembly and all parts are of painted, molded plastic although wood makes an excellent material for the purpose and is illustrated. The design is realistic and pleasing and the curvilinear design aspect which makes the puzzle more interesting and challenging is also repeated in the front appearance of the play doll house.

Figure 4:
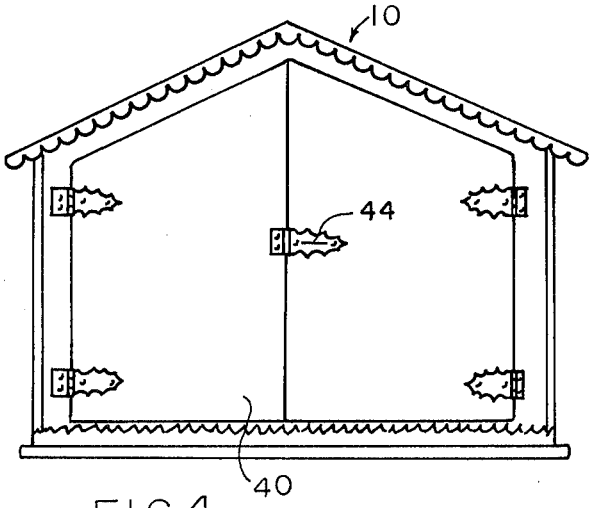
FIG. 4 is a rear elevational view of the play doll house with the doors closed, on a reduced scale.

FIG. 4 shows a rear elevational view with the dual outside-hinged doors 40 closed and latched at 44, as for containing the puzzle-type nesting array of furniture in storage.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In an assemblage of play doll house and furniture, the improvement comprising: the furniture including a plurality of furniture pieces of various sizes but all having spaced surfaces defining one common dimension; the play doll house having an interior space containing the plurality of furniture pieces in puzzle-type nesting array with the respective spaced surfaces of each of the plurality of furniture pieces being in respective planar relation with those of the other furniture pieces of said plurality, the plurality of furniture pieces comprising a variety of types of furniture pieces, plural of which have curvilinear shape, the interior space having enclosing roof, floor, sidewalls and an end wall, of the play doll house, with the end wall defining a said planar relation of the furniture pieces in puzzle-type nesting array, said puzzle-type nesting array of furniture forming an outline shape substantially fitting said interior space, said roof being a gable roof and said interior space having a shape with a single axis of symmetry through the gable roof, the plurality of furniture pieces forming an asymmetrical pattern within said outline shape, means providing first and second degrees of difficulty in assembling the furniture pieces in puzzle-type nesting array in respective first and second orientations one hundred and eighty degrees apart about said single axis of symmetry, including pattern indication means on said end wall, a door on said play doll house defining a second said planar relation of the furniture pieces in puzzle-type nesting array and operable for retaining the furniture pieces in the play doll house, and the play doll house having a recognizable-style exterior such as Swiss Chalet style.

* * * * *